US009488178B2

(12) United States Patent
Kim et al.

(10) Patent No.: US 9,488,178 B2
(45) Date of Patent: Nov. 8, 2016

(54) CANNED MOTOR PUMP FOR VEHICLE

(71) Applicants: Hyundai Motor Company, Seoul (KR); Kia Motors Corporation, Seoul (KR)

(72) Inventors: Hark Koo Kim, Seoul (KR); Seung Yong Lee, Yongin-si (KR); Chi Myung Kim, Yongin-si (KR); Jong Won Park, Changwon-si (KR); Chang Gook Lee, Changwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 341 days.

(21) Appl. No.: 14/046,881

(22) Filed: Oct. 4, 2013

(65) Prior Publication Data

US 2015/0023823 A1 Jan. 22, 2015

(30) Foreign Application Priority Data

Jul. 18, 2013 (KR) ..... 10-2013-0084512

(51) Int. Cl.
*F04D 13/06* (2006.01)
*F04D 29/66* (2006.01)

(52) U.S. Cl.
CPC ..... *F04D 13/0606* (2013.01); *F04D 13/0626* (2013.01); *F04D 29/669* (2013.01)

(58) Field of Classification Search
CPC ..... F04D 13/0606; F04D 13/0626; F04D 29/669; H02K 15/14
USPC ..... 417/423.11
See application file for complete search history.

(56) References Cited

U.S. PATENT DOCUMENTS 3,254,248 A * 5/1966 Hagen ..... H02K 5/128 310/86
3,548,229 A * 12/1970 Evans ..... H02K 5/04 310/89
4,395,204 A * 7/1983 Turner ..... F04B 53/126 277/336
2006/0017339 A1 1/2006 Chordia et al.
2006/0057003 A1 3/2006 Mitsuda et al.
2008/0075586 A1 3/2008 Fukuki et al.
2011/0033320 A1 2/2011 Heier et al.
2012/0180279 A1* 7/2012 Tuery ..... F16B 19/1054 29/243.53

FOREIGN PATENT DOCUMENTS

JP 09-280190 A 10/1997
JP 2003-222095 A 8/2003

(Continued)

OTHER PUBLICATIONS

Korean Office Action issued in Korean Application No. 10-2013-0084512 dated Sep. 24, 2014.

(Continued)

*Primary Examiner* — Patrick Hamo
(74) *Attorney, Agent, or Firm* — McDermott Will & Emery LLP

(57) ABSTRACT

A canned motor pump includes a stator assembly and a housing surrounding the outer portion of the state assembly. The housing is coupled with the stator assembly in a state in which the housing is divided into a plurality of pieces by cutting lines, and has a through-hole in a side portion into which a fastener is fastened. A fixing ring is coupled to the inside of the housing and the stator assembly so as to provide a seal between the housing and the stator assembly.

10 Claims, 2 Drawing Sheets

(56) References Cited

FOREIGN PATENT DOCUMENTS

| | | | |
|---|---|---|---|
| JP | 2005-315184 | A | 11/2005 |
| JP | 2010-236539 | A | 10/2010 |
| JP | 4599018 | B2 | 12/2010 |
| JP | 2014-039366 | A | 2/2014 |
| KR | 92-18305 | U | 10/1992 |
| KR | 93-7587 | U | 4/1993 |
| KR | 10-1995-0003639 | A | 2/1995 |
| KR | 10-2000-0007175 | A | 2/2000 |
| KR | 10-2002-0015303 | A | 2/2002 |
| KR | 2003-0066157 | A | 8/2003 |
| KR | 10-0556817 | B1 | 2/2006 |
| KR | 10-0595730 | B1 | 6/2006 |
| KR | 10-2007-0064314 | A | 6/2007 |
| KR | 10-2008-0051209 | A | 6/2008 |
| KR | 10-2009-0002830 | A | 1/2009 |
| KR | 10-0918425 | B1 | 9/2009 |
| KR | 10-2010-0050986 | A | 5/2010 |
| KR | 10-1134969 | B1 | 4/2012 |
| KR | 10-1186212 | B1 | 9/2012 |
| KR | 10-2012-0113102 | A | 10/2012 |

OTHER PUBLICATIONS

Korean Office Action issued in Korean Application No. 10-2013-0084513 dated Sep. 25, 2014.

Korean Office Action issued in Korean Application No. 10-2013-0084514 dated Sep. 25, 2014.

Korean Notice of Allowance issued in Korean Application No. 10-2013-0084513 issued on Feb. 27, 2015.

Korean Notice of Allowance dated Jun. 3, 2015 issued in Korean Patent Application No. 10-2013-0084512.

* cited by examiner

CANNED MOTOR PUMP FOR VEHICLE

CROSS-REFERENCE TO RELATED APPLICATION

This application claims the benefit of priority to Korean Patent Application No. 10-2013-0084512, filed on Jul. 18, 2013 in the Korean Intellectual Property Office, the disclosure of which is incorporated herein in its entirety by reference.

TECHNICAL FIELD

The present disclosure relates to a canned motor pump in which a can structure is interposed between a rotor and a stator.

BACKGROUND

Vehicles are provided with a water pump which circulates cooling water and an oil pump which circulates oil. The water pump can be divided into an engine powered water pump which operates by receiving power from an engine through a belt connected to an engine rotary shaft, and an electrical water pump which operates by a battery. Since the electric water pump does not require power from the engine, it improves fuel efficiency and precisely controls the temperature of cooling water.

In a typical motor, a stator assembly is fixed to a housing. The stator assembly is press-fitted into the housing after expanding the housing by high-frequency heating for time saving purpose.

Although this hot-fitting method is simple to operate and can obtain strong fastening force, this method is not applicable for a sliding structure assembly.

Korean Laid-Open Patent Publication No. 10-2003-0066157 A, titled "STRUCTURE FOR FIXING INNER STATOR OF COOLER," was made in order to overcome the problem of the related art. This publication relates to the structure for fixing an inner stator of a cooler which is bonded and fixed to the outer circumference of a cylinder. Specifically, male threads are formed on one end of the cylinder, and a hollow disk-shaped fixing ring having female threads spirally engages into the cylinder having the male threads so that the inner stator is fixed to the outer circumference of the cylinder.

However, the structure and process are complicated, abrasion occurs, and there are gaps causing vibration and noises.

Accordingly, a canned motor pump that has a simple structure and process, removes vibration and noise, and has superior endurance is required.

The foregoing is intended merely to aid in the understanding of the background of the present disclosure, and is not intended to mean that the present disclosure falls within the purview of the related art that is already known to those skilled in the art.

SUMMARY OF THE DISCLOSURE

An aspect of the present disclosure provides a canned motor pump which has a simple structure and process, removes vibration and noise, and has superior endurance.

According to an exemplary embodiment of the present disclosure, a canned motor pump includes a stator assembly. A housing surrounds an outer portion of the stator assembly, the housing is coupled with the stator assembly in a state in which the housing is divided into a plurality of pieces by cutting lines, and has a through-hole on a side portion into which a fastener is fastened. A fixing ring is coupled to an inside of the housing and the stator assembly so as to provide a seal between the housing and the stator assembly.

The stator assembly may include a stator and a pipe-shaped outer ring surrounding an outer circumference of the stator.

The housing may include two pieces having an identical shape, and the cutting lines may be disposed at corresponding positions when the two pieces of the housing are coupled with each other.

The through-hole may include a plurality of through-holes which are disposed in an outer portion of the housing at predetermined distances.

The through-hole may be disposed at an upper portion of the housing that is at least a half of a height of the housing.

The fastener may comprise a headless bolt.

The housing may have a stepped projection which protrudes inward from a position that adjoins to a lower surface of the outer ring. The stator assembly may be supported by the stepped projection so as not to be dislodged when the outer ring is pressed downward.

The through-hole may be disposed at a position corresponding to an upper portion of the outer ring, such that, when the fastener is fastened into the through-hole, the fixing ring is pressed by the housing and the outer ring is pressed downward by the fixing ring.

The fixing ring may be tightly coupled with an upper portion of the stator assembly.

The fixing ring may be tightly coupled with an upper portion of the outer ring of the stator assembly. A radius of the fixing ring may be greater than a radius of the outer ring.

The fixing ring may have a cylindrical shape having a side portion which extends by a predetermined length in a top-bottom direction. The fixing ring may include an upper flange which extends outward from an upper end of the side portion, and a lower flange which extends outward from a lower end of the side portion.

The side portion of the fixing ring may have a taper which increases in a width direction from the upper flange to the lower flange.

The fixing ring may have a cylindrical shape having a side portion which extends by a predetermined length in a top-bottom direction. The fixing ring may include an upper flange which extends outward from an upper end of the side portion and a lower flange which extends outward from a lower end of the side portion. The side portion may have a taper which increases in a width direction from the upper flange to the lower flange, whereby, when the fastener is fastened into the housing, the housing is pressed outward by the upper flange, and the outer ring is pressed outward by the lower flange.

According to the canned motor pump having the above-described structure, the stator assembly and the housing are fixed to each other through a simple assembly of the fasteners into the through-holes without having additional heat treatment of the stator assembly and the housing. This consequently simplifies the fabrication process and reduces manufacturing time.

In addition, it is possible to fix the sliding structure and easily assemble the sliding structure, thereby improving productivity. Since no heat treatment process is carried out, high fastening force can be maintained at high temperature. This provides strong endurance reliability in a hot environment, thereby improving product quality. Furthermore, gaps can be removed, thereby reducing vibration and impact.

BRIEF DESCRIPTION OF THE DRAWINGS

The above and other objects, features, and other advantages of the present disclosure will be more clearly understood from the following detailed description when taken in conjunction with the accompanying drawings.

DETAILED DESCRIPTION

Hereinbelow, exemplary embodiments of a canned motor pump according to the present disclosure will be described in detail with reference to the accompanying drawings.

Figure 1:
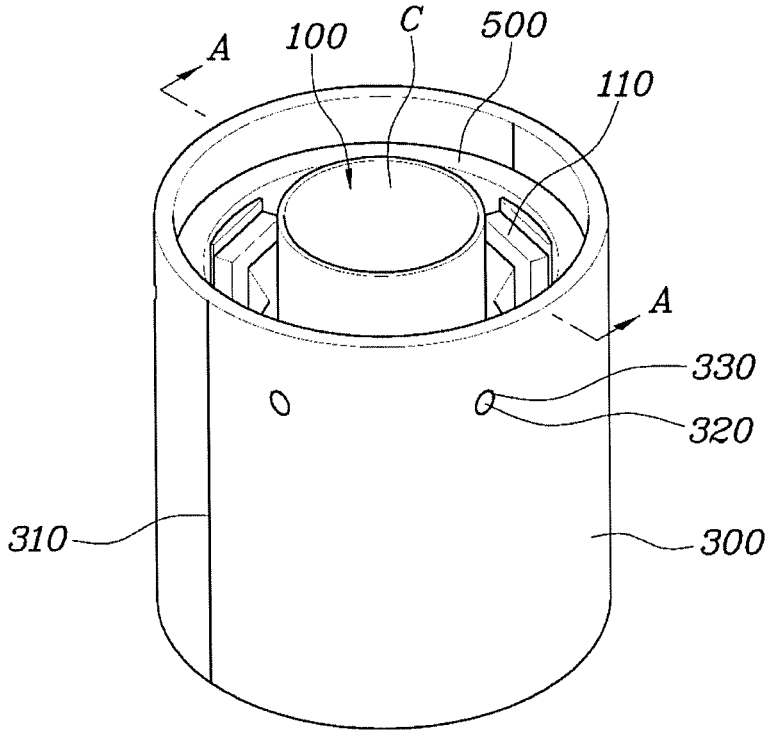
FIG. 1 is a perspective view showing a canned motor pump according to an embodiment of the present disclosure.
Figure 2:
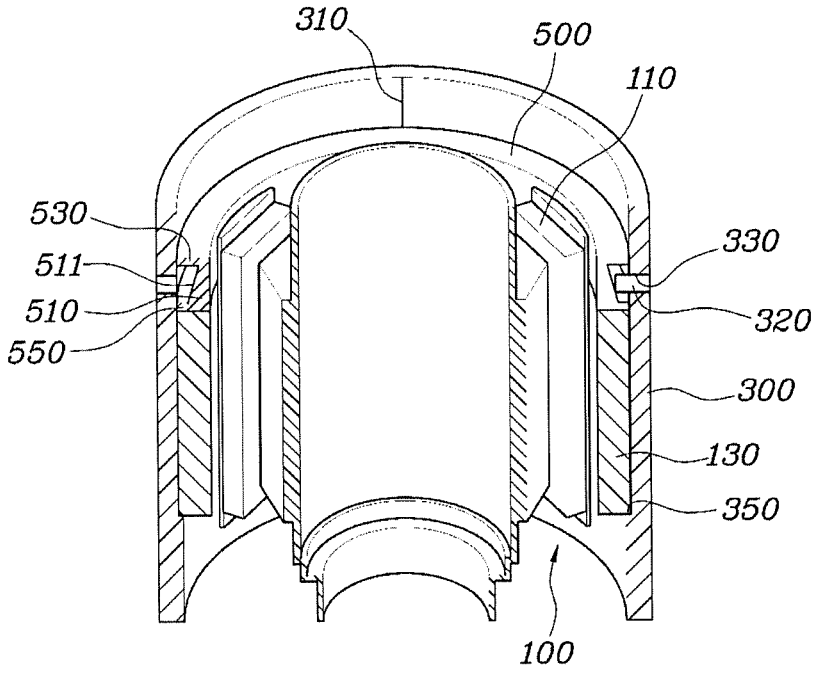
FIG. 2 is a cross-sectional view taken line A-A in FIG. 1.

FIG. 1 is a perspective view showing a canned motor pump according to an embodiment of the present disclosure, and FIG. 2 is a cross-sectional view taken line A-A in FIG. 1. The canned motor pump according to an exemplary embodiment of the present disclosure includes a stator assembly 100 and a housing 300 which surrounds the outer side portion of the stator assembly 100. The housing 300 is coupled with the stator assembly 100 in the state in which the housing 300 is divided into a plurality of pieces by cutting lines 310. The housing 300 has through-holes 330 on a side into which a fastener 320 is fastened. The canned motor pump also includes a fixing ring 500 which is coupled to an inside of the housing 300. The fixing ring 500 is coupled with the stator assembly 100 so as to provide a seal between the housing 300 and the stator assembly 100.

A can part C extends through the inside of the stator assembly 100, and the stator assembly 100 includes a stator 110 and an outer ring 130 which surrounds an outer circumference of the stator 110. In the related art, when fixing the stator assembly 100 to the housing 300, the housing 300 was enlarged by high-frequency heating before the stator assembly 100 was press-fitted into the housing 300. However, this hot fitting method cannot be used for the sliding structure. Therefore, the method of coupling the housing 300 from outside the stator assembly 100 is used.

The housing 300 is divided into two pieces by the two cutting lines 310 which extend in a longitudinal direction, the two pieces being coupled so as to surround the outer side portion of the stator assembly 100. When the housing 300 is coupled with the stator assembly 100, the cutting lines 310 are formed at mutually corresponding positions. The number of the cutting lines 310 and the pieces depending on design can be changed.

Since the housing 300, which is divided into pieces, is coupled with the stator assembly 100 by surrounding it from outside, it is not necessary to perform heat treatment on the housing 300. This consequently simplifies the process, and high fastening force can be maintained at high temperature, thereby ensuring reliable endurance that is strong in hot environments.

In particular, since the housing 300 is shrunk after being expanded due to heat treatment, a certain gap necessarily occurs when fixing the stator assembly 100 to the inside of the housing 300. The gap causes vibration and impact during rotation of the motor. However, when the housing 300 and the stator assembly 100 are coupled with each other according to the present disclosure, the gap between the housing 300 and the stator assembly 100 can be removed, whereby vibration or noise does not occur during operation of the motor.

In addition, a plurality of through-holes 330 is formed at certain intervals in the outer side portion of the housing 300. The fasteners 320 are coupled with the through-holes 330 by extending through the same. The through-holes 330 are formed in the upper portion that is at least half of the height of the housing 300.

The through-holes 330 are formed at positions corresponding to the upper side portions of the outer ring 130 of the stator assembly 100. When the fasteners 320 are fastened, the housing 300 is gradually pressed. The fixing ring 500 is pressed by the housing 300, an upper flange 530 of the fixing ring 500 presses the housing 300 outward, and a lower flange 550 of the fixing ring 500 is distorted, thereby pressing the outer ring 130 downward.

While the fasteners 320 can be implemented as one selected from among a variety of fasteners, headless bolts are used in the present disclosure such that no fastener protrudes from the surface of the housing 300.

The housing 300 has a stepped projection 350 formed on the inner surface thereof which protrudes inward from a position that adjoins to the lower surface of the outer ring 130 of the stator assembly 100. The stator assembly 100 is supported on the housing 300 by being seated on the upper surface of the stepped projection 350.

In particular, although the fixing ring 500 presses the outer ring 130 downward due to coupling of the housing 300, the stator assembly 100 is not dislodged from the housing 300 since it is stopped and supported by the stepped projection 350 of the housing 300.

Although the configuration as described above has been described as the stator assembly 100 including the stator 110 and the outer ring 130, it can be applied all types of canned motors which do not include both the stator 110 and the outer ring 130.

The fixing ring 500 is tightly coupled with the upper portion of the stator assembly 100, in particularly, to the upper portion of the outer ring 130 of the stator assembly 100. The radius of the fixing ring 500 is set greater than the radius of the outer ring 130. When the housing 300 is coupled with the fixing ring 500, the fixing ring 500 gradually comes into tighter contact with the housing 300, and thus becomes distorted.

The fixing ring 500 has a cylinder shape having a side portion 510 which extends by a certain length in the top-bottom direction. The upper flange 530 which extends outward is formed on the upper end of the side portion 510 of the fixing ring 500, and the lower flange 550 which extends outward is formed on the lower end of the side portion 510 of the fixing ring 500. The side portion 510 of the fixing ring 500 has a taper 511 which gradually increases in a width direction from the upper flange 530 to the lower flange 550. Due to this configuration, when the fastener 320 is fastened to the housing 300, the fixing ring 500 is distorted so that the upper flange 530 presses the housing 300 outward and the lower flange 550 presses the outer ring 130 downward, thereby realizing reliable sealing effect.

According to the canned motor pump of the present disclosure, the stator assembly 100 and the housing 300 are fixed to each other due to simple assembly of the fasteners 320 into the through-holes 330 without additional heat treatment of the stator assembly 100 and the housing 300. This consequently simplifies the fabrication process and reduces manufacturing time.

In addition, it is possible to fix the sliding structure as well and easily assemble the sliding structure, thereby improving productivity. Likewise, since no heat treatment process is carried out, high fastening force can be maintained at high temperature. This provides strong endurance reliability in a hot environment, thereby improving product quality. Furthermore, the gaps can be removed, thereby reducing vibration and impact.

Although an exemplary embodiment of the present disclosure has been described for illustrative purposes, those skilled in the art will appreciate that various modifications, additions and substitutions are possible, without departing from the scope and spirit of the disclosure as disclosed in the accompanying claims.

What is claimed is:

1. A canned motor pump comprising:

a stator assembly;

a housing surrounding an outer portion of the stator assembly, the housing being coupled with the stator assembly in a state in which the housing is divided into a plurality of pieces by cutting lines, and having a through-hole on a first side portion into which a fastener is fastened; and a fixing ring coupled to an inside of the housing and the stator assembly so as to provide a seal between the housing and the stator assembly, wherein the fixing ring has a cylindrical shape having a second side portion which extends by a predetermined length in a top-bottom direction, the fixing ring comprising an upper flange which extends outward from an upper end of the second side portion and a lower flange which extends outward from a lower end of the second side portion, wherein the stator assembly comprises a stator and a pipe-shaped outer ring surrounding an outer circumference of the stator, and wherein when the fastener is fastened into the housing, the housing is pressed outward by the upper flange, and the outer ring is pressed downward by the lower flange.

2. The canned motor pump according to claim 1, wherein the housing comprises two pieces having an identical shape, and the cutting lines are disposed at corresponding positions when the two pieces of the housing are coupled with each other.

3. The canned motor pump according to claim 1, wherein the through-hole comprises a plurality of through-holes which are disposed in an outer portion of the housing at predetermined distances.

4. The canned motor pump according to claim 1, wherein the through-hole is disposed at an upper portion of the housing that is at least a half of a height of the housing.

5. The canned motor pump according to claim 1, wherein the fastener comprises a headless bolt.

6. The canned motor pump according to claim 1, wherein the housing has a stepped projection which protrudes inward from a position that adjoins to a lower surface of the outer ring, wherein the stator assembly is supported by the stepped projection so as not to be dislodged when the outer ring is pressed downward.

7. The canned motor pump according to claim 1, wherein the through-hole is disposed at a position corresponding to a portion of the fixing ring, such that, when the fastener is fastened into the through-hole, the fixing ring is pressed by the housing and the outer ring is pressed downward by the fixing ring.

8. The canned motor pump according to claim 1, wherein the fixing ring is tightly coupled with an upper portion of the stator assembly.

9. The canned motor pump according to claim 1, wherein the fixing ring is tightly coupled with an upper portion of the outer ring of the stator assembly.

10. The canned motor pump according to claim 1, wherein the second side portion of the fixing ring has a taper which increases in a width direction from the upper flange to the lower flange.

* * * * *